US005248160A

United States Patent [19]

Le Masson et al.

[11] Patent Number: 5,248,160

[45] Date of Patent: Sep. 28, 1993

[54] SKI WITH FOAM FILLER

[75] Inventors: Jacques Le Masson, Cran Gervrier; Dominique Vuarier, Saint Jorioz, both of France

[73] Assignee: Salomon S.A., France

[21] Appl. No.: 834,789

[22] Filed: Feb. 13, 1992

[30] Foreign Application Priority Data

Feb. 14, 1991 [FR] France ..... 91 01918

[51] Int. Cl.[5] ..... A63C 5/00

[52] U.S. Cl. ..... 280/610

[58] Field of Search ..... 280/601, 602, 608, 609, 280/610, 817; 441/68, 74

[56] References Cited

U.S. PATENT DOCUMENTS

| | | | |
|---|---|---|---|
| 3,863,944 | 2/1975 | Waddel | 280/817 |
| 4,409,287 | 10/1983 | Harrison | 280/610 |
| 4,681,725 | 7/1957 | Marugama | 280/610 |
| 5,122,085 | 6/1992 | Heath | 441/74 |

FOREIGN PATENT DOCUMENTS

| | | | |
|---|---|---|---|
| 378324 | 7/1985 | Austria . | |
| 2909678 | 9/1980 | Fed. Rep. of Germany . | |
| 3236016 | 4/1984 | Fed. Rep. of Germany | 280/601 |
| 2565836 | 12/1985 | France . | |

*Primary Examiner*—Richard M. Camby

*Attorney, Agent, or Firm*—Pollock, Vande Sande & Priddy

[57] ABSTRACT

Ski comprising a lower sub-assembly providing mechanical resistance (2) and an upper cover sub-assembly (3). The lower sub-assembly (2) comprises an outer sole plate for sliding (20), lateral metal edges (21), a core (22), at least one lower reinforcement piece (23) and at least one upper reinforcement piece (24). The upper sub-assembly (3) comprises at least one thin, flexible outer membrane (30) and a filling material (31) made of deformable, elastic plastic foam interposed over at least a portion of the length of the ski between the membrane (30) and the upper reinforcement piece (24).

9 Claims, 5 Drawing Sheets

SKI WITH FOAM FILLER

FIELD OF THE INVENTION

The invention relates to a ski used in winter sports and designed to slide on snow and ice.

The current structure of skis generally comprises two separate sub-assemblies, each having its own function.

A first sub-assembly, termed "mechanical," unites the elements imparting sliding, stiffness, gripping, and resistance properties to the ski, while a second protective, decorative sub-assembly is designed to cover and protect the first, at least partially.

BACKGROUND OF THE INVENTION

Prior art reveals that this second sub-assembly is most often constituted by deformation- and abrasion-resistant layers, which can be decorated using a rigid plastic material such as ABS (acrylonitrile butadiene styrene), polyamide, or a metal such as aluminum.

Nevertheless, the use of these materials does not make it possible to produce special shapes on the top of the ski, except by adding to the weight of the assembly or by altering the mechanical properties of the ski, e.g., stiffness, an alteration that is not always desirable.

FR 2,589,073 proposes the creation, around a mechanical assembly of a ski, of a U-shaped shell made of a hard polyurethane plastic material applied by spraying, molding or RIM (reaction injection molding). This construction allows the manufacture of skis having differing complex shapes, while retaining a single mechanical sub-assembly with carefully-designed, advantageous properties. However, this sub-assembly offers limited decorative possibilities. Furthermore, overly aggressive blows of the ski edges may seriously damage this covering layer, and the resistance of this covering is not optimal over time.

SUMMARY OF THE INVENTION

The object of the present invention is to propose a ski which solves the above-mentioned problems.

In particular, the construction of the ski is such that complex shapes can be produced without adding weight to the ski or altering its mechanical properties.

The upper sub-assembly can be easily decorated using different procedures. In use, it is resistant to blows from ski edges and other sources of damage.

In addition, procedures used to manufacture this ski are numerous, normally easy to implement, and economical.

To this end, the ski according to the invention is constituted by a lower sub-assembly whose function is mechanical resistance, and an upper sub-assembly whose function is to cover the lower one. The lower resistance sub-assembly further comprises:

an external sole plate for sliding;

lateral metal edges;

a central core;

at least one upper reinforcement piece; and at least one lower reinforcement piece.

The upper cover sub-assembly comprises at least one external thin, flexible membrane and a plastic foam filling material, deformable and elastic, which is interposed, at least over a portion of the length of the ski, between the membrane and the upper reinforcement element.

BRIEF DESCRIPTION OF THE DRAWINGS

Other objects and advantages of the present invention will emerge more clearly from the following description of several embodiments provided with reference to the attached drawings.

DETAILED DESCRIPTION

Figure 1:
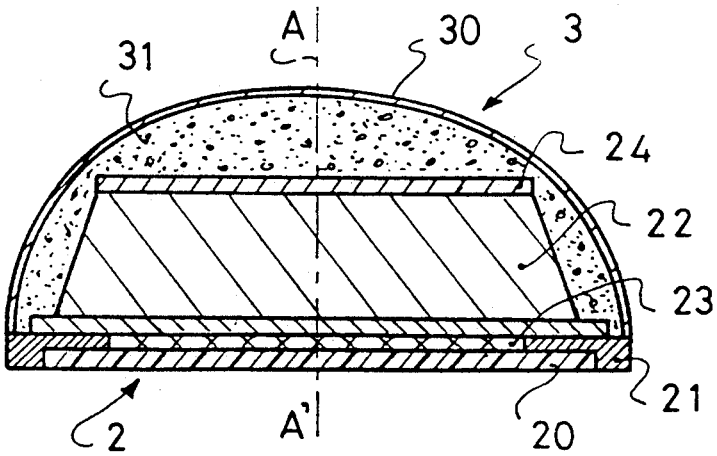
FIG. 1 is a transverse cross-section, along line B—B' in FIG. 2, of a ski according to the present invention.

As shown in FIG. 1, the ski 1 according to the present invention comprises a lower mechanical assembly 2 incorporating a sole plate 20 for sliding, generally made of polyethylene, PTFE, or another substance.

Lateral metal edges 21 are positioned on either side of the sole 20 and provide good gripping action of the ski in turns, under all snow or ice conditions. The lower sub-assembly 2 also comprises a stack of mechanical elements, including one or several lower reinforcement pieces 23 covering the sole plate, a central core 22, and an upper reinforcement piece 24. At least one portion of the lower reinforcement piece 23 extends laterally and covers the edges 21, at least partially.

The reinforcement pieces 23, 24 are generally constituted by one or several layers of composite materials made of glass fibers, carbon fibers or other fibers and impregnated with a thermosetting resin material such as epoxy or polyester. They may also be made of aluminum or a zycral-type aluminum alloy.

The core 22 may be made, for example, of a foam, filled or unfilled, wood, or aluminum honeycomb material.

The different components of the upper mechanical assembly 2 are assembled together using any method, such as gluing or welding.

The bonding interface between each of these components may be produced using glue films, for example (not shown).

The upper cover sub-assembly 3 is designed to protect the mechanical sub-assembly 2 and comprises a external thin, flexible membrane 30 which covers the mechanical unit 2 from one edge to the other. This membrane may be a textile material, or a film or sheet made of a flexible plastic substance. The desirable thickness of the membrane is 0.1 to 0.5 mm, so as to enable it to resist blows from the edges and abrasion while retaining total flexibility.

Figure 2:
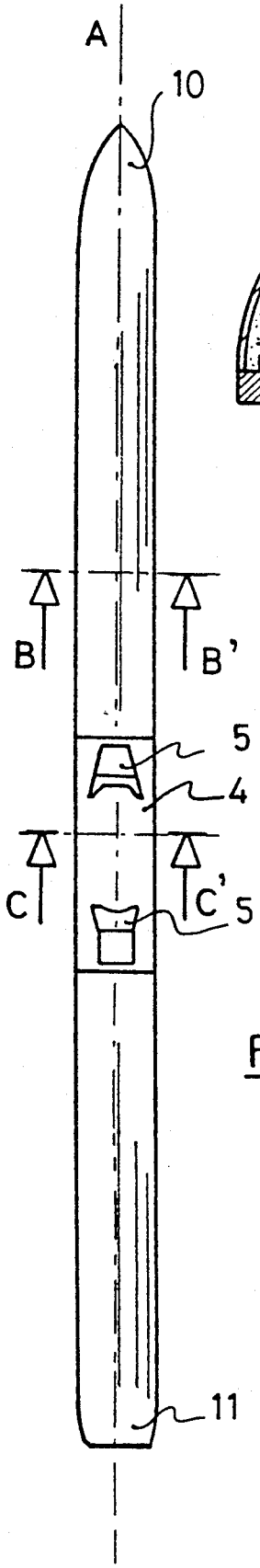
FIG. 2 is a top plan view of of the ski in FIG. 1.

The membrane preferably extends over the entire length of the ski, from its tip 10 to its rear end 11, as illustrated in FIG. 2. A filling material 31 made of a deformable, elastic plastic foam is interposed between the membrane 30 and the lower mechanical sub-assembly 2.

This material may extend as an interface over all or a part of the ski in a continuous or discontinuous manner, thus acting as a "buffer", in particular in the parts of the ski most subjected to shocks and external attacks.

Figure 3:
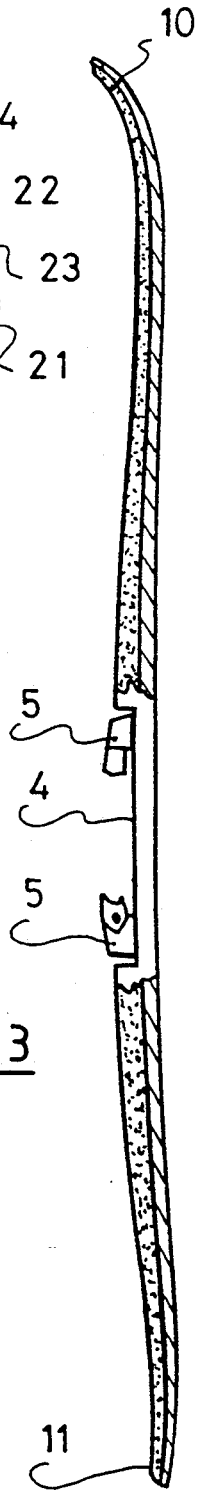
FIG. 3 is a longitudinal cross-section, along line A—A', of the ski in FIG. 2.
Figure 4:
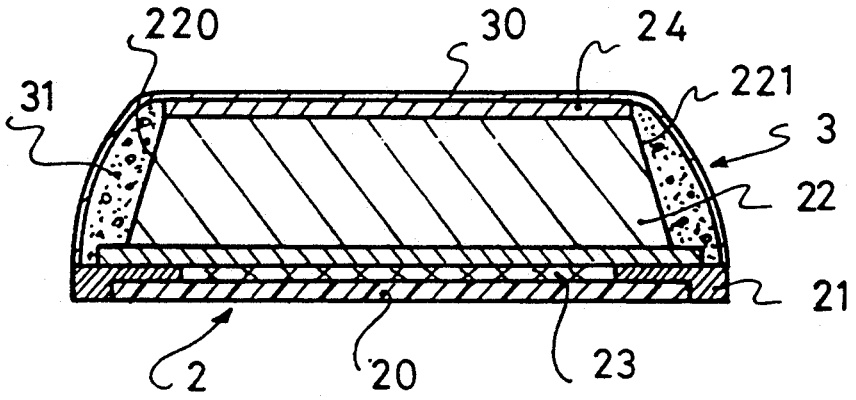
FIG. 4 is a transverse cross-section along line C—C' of the ski in FIG. 2.

As an example, FIGS. 3 and 4 show a ski whose membrane 30 is adjacent to the upper reinforcement piece 24 in the zone 4 where the bindings 5 are designed to fit.

In this zone, in the area of the edges, the filling material 31 is interposed only between the lateral surfaces 220, 221 of the core 22 and the membrane 30.

The thickness of the filling material may be variable or uniform, longitudinally and/or laterally along the body of the ski, imparting to the ski its own external shape.

The density ratio of the filling material is between 0.2 and 0.4. As an example, polyethers or polyurethanes may be used.

Figure 5:
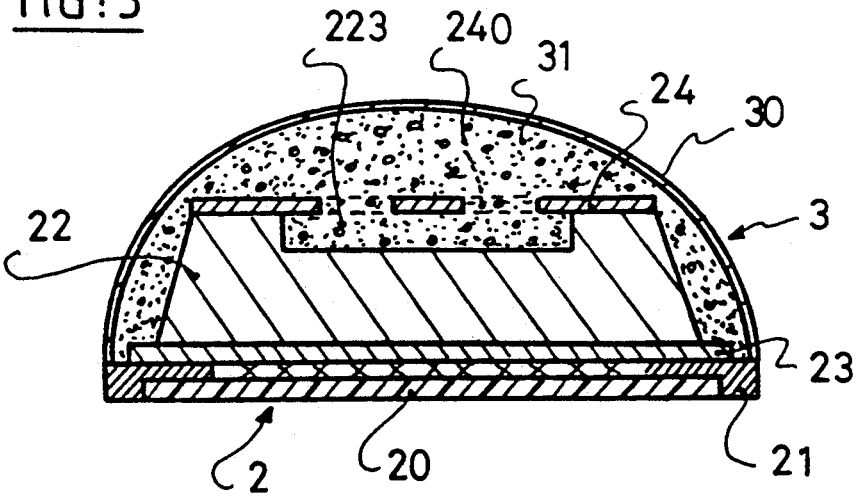
FIG. 5 is a transverse cross-section of a ski according to a second embodiment of the invention.

FIG. 5 illustrates a second embodiment of the ski according to the invention, in which the filling material extends beyond the reinforcement piece in order to fill a cavity 223 extending over all or a part of the ski within the core 22, through holes 240 in the upper reinforcement piece 24. This embodiment has the advantage of improving adhesion by mechanical attachment of the upper cover sub-assembly 3 to the lower mechanical sub-assembly 2.

Figure 7:
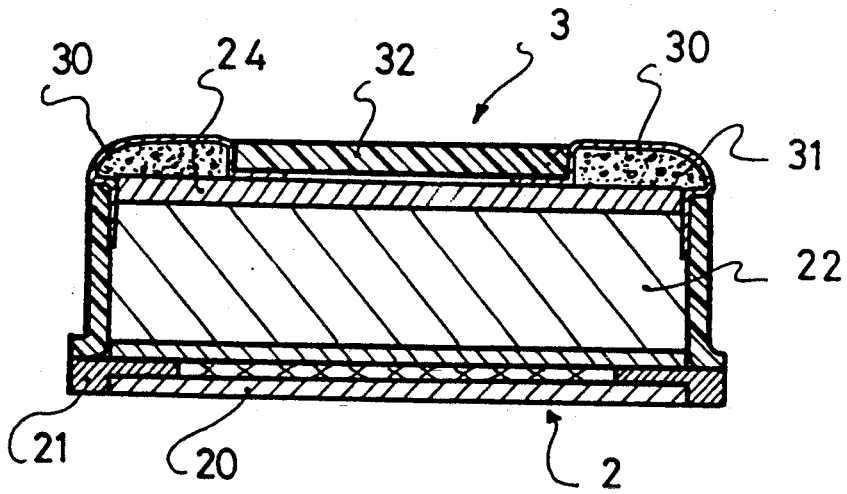
FIG. 7 is a transverse cross-section along line D—D' of the ski in FIG. 6.
Figure 6:
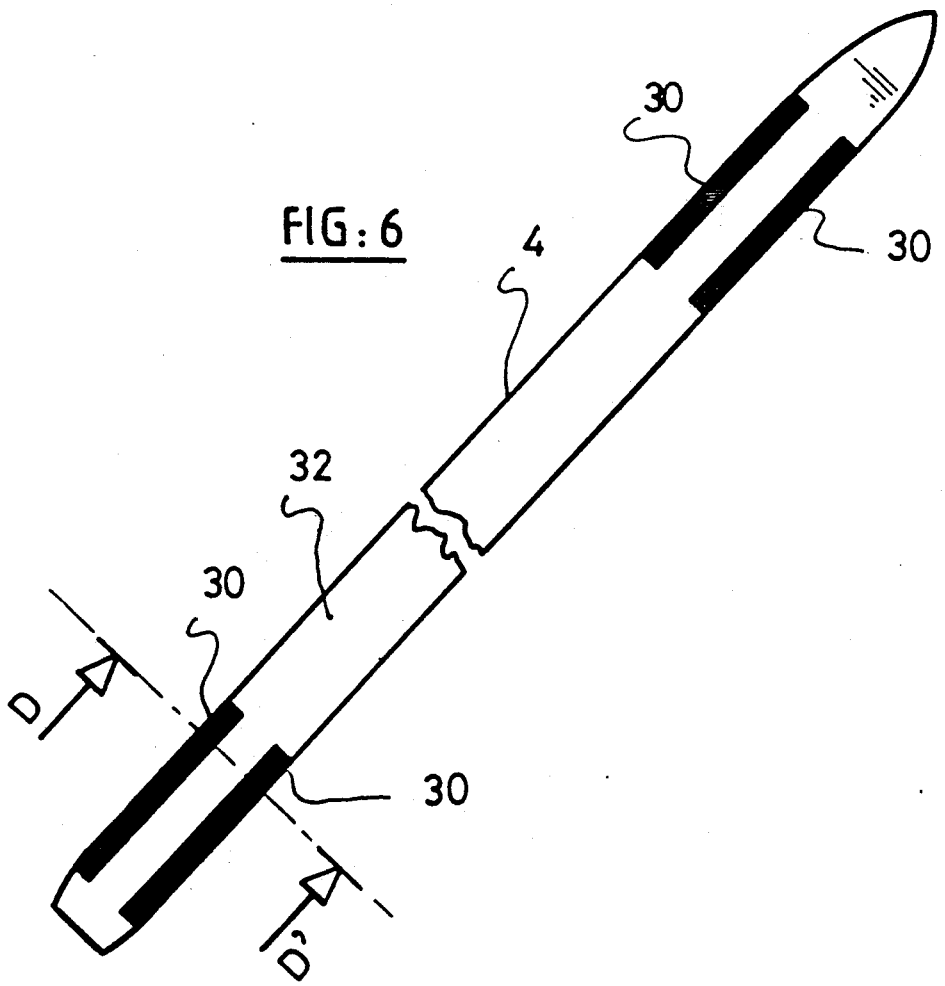
FIG. 6 is a top plan view of a ski according to a third embodiment of the invention.

FIGS. 6 and 7 illustrate a third embodiment of the ski according to the invention in which the upper cover sub-assembly 3 is constituted by a rigid external shell 32 covering the entire length of the ski and extending laterally from one edge 21 to the other. This shell 32 is provided with openings at the points most exposed to external attacks, especially in the area of the upper edges, in front of and behind the area of the binding 4. Each localized opening is covered with a membrane 30 whose edges adhere to the inner surface of the shell 32. The filling material 31 made of deformable, elastic plastic foam fills the openings and is interposed between the membrane 30 and the upper reinforcement piece 24. The outer shell 32 may be single- or multi-layered. It may be made of metal, e.g., aluminum, or constituted by reinforced or non-reinforced plastic materials.

Adhesion between the materials of the upper sub-assembly 3 and those of the lower sub-assembly may, in certain cases and because of their natures, be difficult to produce because of incompatibility. An additional interface (not shown) may be provided in the form, for example, of a glue layer or of films or a solid sheet of binding agent.

Figure 8:
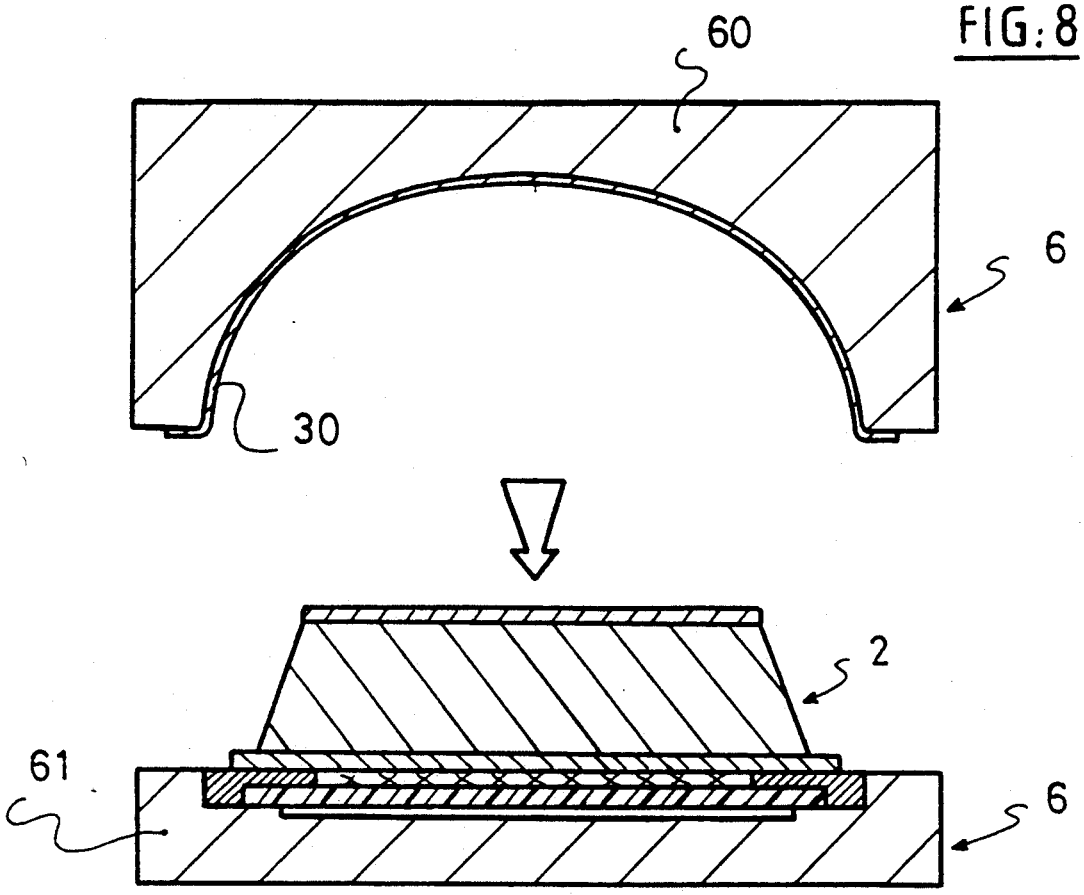
FIGS. 8 and 9 illustrate the different steps of an overall manufacturing process of a ski according to the invention.
Figure 9:
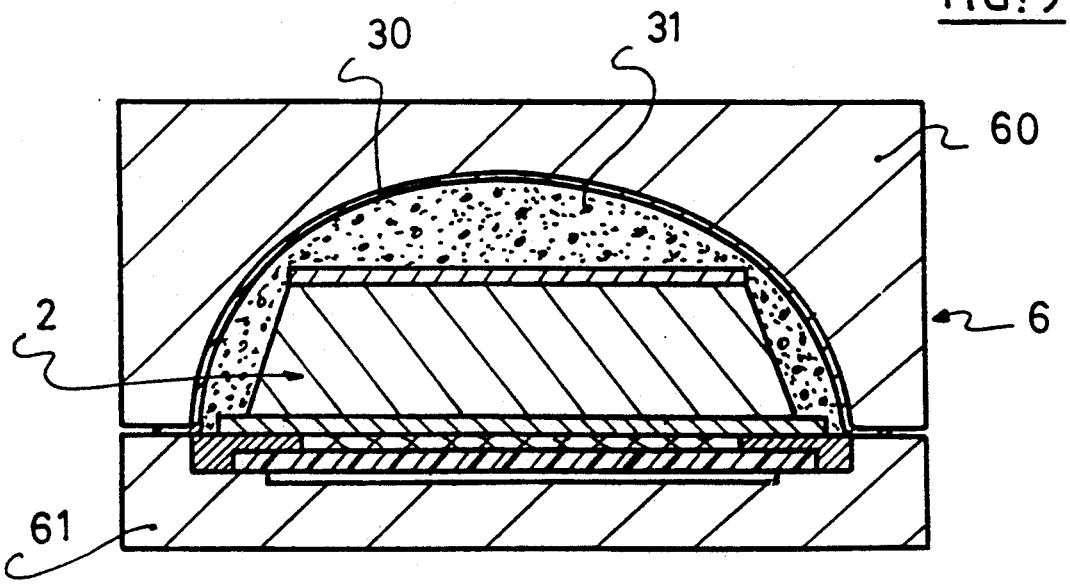

FIGS. 8 and 9 illustrate schematically an example of a process of manufacture of the ski according to the invention.

A first step involves placing the membrane 30 in the part 60 of the mold 6 whose impression determines the shape of the upper part of the ski. A second step consists in assembling the different elements of the lower mechanical assembly 2, in fastening this assembly to the second part 61 of the mold 6, and then in positioning this assembly so that it covers the first part 60 of the mold, a space being created at the desired points between the member 30 and the mechanical sub-assembly 2. During a third step, the space is filled by injection of the filling material 31.

This injection step may be carried out according to the reaction injection molding process (RIM) well known to those skilled in the art, when the nature of the materials used makes this possible. A final step involves unmolding the ski thus produced and in cutting out any burrs in the membrane produced on the ski in the area of the plane of the mold 6 joint.

Figure 10:
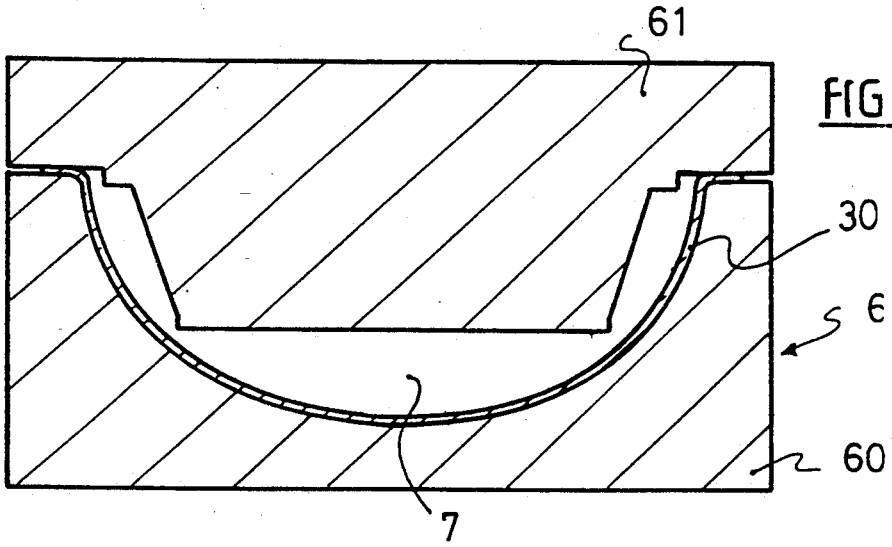
FIGS. 10 to 12 represent the different steps of another ski-manufacturing process according to the invention.
Figure 11:
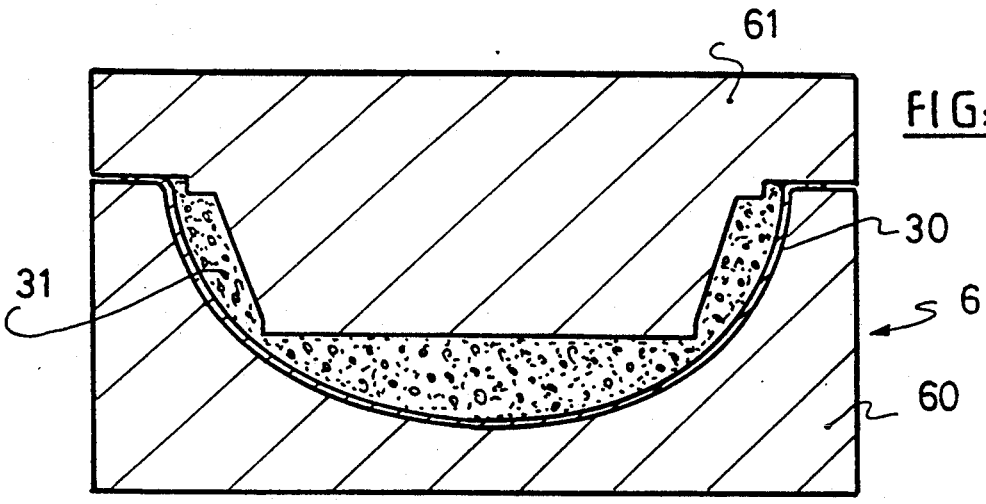
Figure 12:
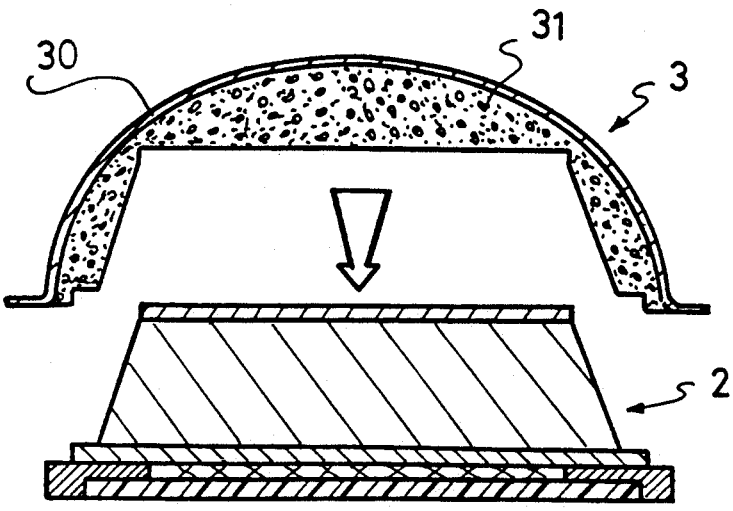

Another embodiment of the manufacturing process is illustrated in FIGS. 10 to 12.

In this process, the upper cover sub-assembly 3 and the lower mechanical sub-assembly 2 are manufactured separately, and are then assembled by gluing or any other method. The upper cover sub-assembly is mounted in its desired form, as shown in FIGS. 10 and 11.

To this end, the membrane 30 is placed on one of the parts of the mold 6, the other being intended to delimit the complementary shape of the lower mechanical sub-assembly 2. The space 7 created by the two parts of the mold thus assembled is filled by injection of the foam 31, using, for example, the RIM process. After unmolding, the two sub-assemblies 2 and 3 are assembled and attached using any means, such as gluing or welding.

The latter does not permit the manufacture of a ski according to the FIG. 5 embodiment for which preference will be given to the first process described, for example.

By its nature, the membrane may be decorated equally well before or after implementation of the processes described, thus providing a definite advantage as compared with conventional skis, in which the cover layer can be decorated only during the final production stage of the process.

What is claimed is:

1. Ski (1) constituted by a lower sub-assembly (2) providing mechanical resistance and an upper cover sub-assembly (3), said lower sub-assembly comprising (a) an outer sole plate for sliding (20);

(b) lateral metal edges (21) on both sides of said sole plate;

(c) a core (22) having lateral surfaces;

(d) at least one lower reinforcement piece (23) covering said sole plate and at least partly covering said metal edges; and (e) at least one upper reinforcement piece;

(f) wherein said upper cover sub-assembly comprises at least one exterior thin, flexible membrane (30) extending from one of said edges to the other and a deformable, elastic plastic foam filling material (31) which is interposed over at least a portion of a length of said ski between said membrane (30) and said upper reinforcement piece (24).

2. Ski (1) constituted by a lower sub-assembly (2) providing mechanical resistance and an upper cover sub-assembly (3), said lower sub-assembly comprising (a) an outer sole plate for sliding (20);

(b) lateral metal edges (231) on both sides of said sole plate;

(c) a core (22) having lateral surfaces;

(d) at least one lower reinforcement piece (23) covering said sole plate and at least partly covering said metal edges; and (e) at least one upper reinforcement piece;

(f) wherein said upper cover sub-assembly comprises at least one exterior thin, flexible membrane (30) and a deformable, elastic plastic foam filling material (31) extending continuously over an entire length of said ski between said membrane (30) and said upper reinforcement piece (24).

3. Ski (1) constituted by a lower sub-assembly (2) providing mechanical resistance and an upper cover sub-assembly (3), said lower sub-assembly comprising (a) an outer sole plate for sliding (20);

(b) lateral metal edges (21) on both sides of said sole plate;

(c) a core (22) having lateral surfaces;

(d) at least one lower reinforcement piece (23) covering said sole plate and at least partly covering said metal edges; and (e) at least one upper reinforcement piece (24);

(f) wherein said upper cover sub-assembly comprises at least one exterior thin, flexible membrane (30) adjacent to said upper reinforcement piece in which bindings (5) are intended to fit, and a deformable, elastic plastic foam filling material (31) which is interposed over at least a portion of a length of said ski between said membrane (30) and said upper reinforcement piece (24) and between said lateral surfaces of said core and said membrane in the area of said bindings.

4. Ski (1) constituted by a lower sub-assembly (2) providing mechanical resistance and an upper cover sub-assembly (3), said lower sub-assembly comprising (a) an outer sole plate for sliding (20);

(b) lateral metal edges (21) on both sides of said sole plate;

(c) a core (22) having lateral surfaces;

(d) at least one lower reinforcement piece (23) covering said sole plate and at least partly covering said metal edges; and (e) at least one upper reinforcement piece;

(f) wherein said upper cover sub-assembly is constituted by a rigid external shell (32) provided with apertures and is covered by at least one exterior thin, flexible membrane (30) and filled with a deformable, elastic plastic foam filling material (31) which is interposed over at least a portion of a length of said ski between said membrane (30) and said upper reinforcement piece (24).

5. Ski according to any one of claims 1 to 4, wherein said filling material has a variable thickness longitudinally and/or laterally along said ski.

6. Ski according to any one of claims 1 to 4 wherein said membrane has a thickness of between 0.1 and 0.5 mm.

7. Ski according to claim 6, wherein said membrane (30) is made of textile material.

8. Ski according to claim 6, wherein said membrane (30) is made of flexible, plastic material.

9. Ski according to claim 8, wherein said material is selected from the group consisting of polyethers and polyurethanes.

* * * * *